US011692796B1

(12) United States Patent
Hertel

(10) Patent No.: US 11,692,796 B1
(45) Date of Patent: Jul. 4, 2023

(54) OMNI-SPECTRAL THERMAL CAMOUFLAGE, SIGNATURE MITIGATION AND INSULATION APPARATUS, COMPOSITION AND SYSTEM

(71) Applicant: Stealth Labs, LLC, Roswell, GA (US)

(72) Inventor: Marc Hertel, Roswell, GA (US)

(73) Assignee: Stealth Labs, LLC, Roswell, GA (US)

( * ) Notice: Subject to any disclaimer, the term of this patent is extended or adjusted under 35 U.S.C. 154(b) by 0 days.

(21) Appl. No.: 17/946,013

(22) Filed: Sep. 15, 2022

(51) Int. Cl.
*F41H 3/00* (2006.01)
*H01Q 17/00* (2006.01)
*F41H 3/02* (2006.01)

(52) U.S. Cl.
CPC ..... *F41H 3/00* (2013.01); *F41H 3/02* (2013.01); *H01Q 17/004* (2013.01); *Y10S 2/90* (2013.01); *Y10S 428/919* (2013.01); *Y10T 442/259* (2015.04)

(58) Field of Classification Search
CPC . F41H 3/00; F41H 3/02; H01Q 17/004; Y10S 2/90; Y10S 428/919; Y10T 442/259
USPC ..... 442/1–59; 428/919
See application file for complete search history.

(56) References Cited

U.S. PATENT DOCUMENTS 4,034,375 A * 7/1977 Wallin ..... H01Q 17/002 428/113
5,091,243 A 2/1992 Tolbert et al.
6,037,280 A * 3/2000 Edwards ..... D06N 3/0056 427/160
6,379,589 B1 4/2002 Aldissi
6,503,963 B2 1/2003 Toyoda et al.
6,756,931 B2 6/2004 Mukasa et al.
7,412,937 B2 8/2008 Stevens et al.
9,322,953 B2 4/2016 Narimanov
9,894,817 B2 2/2018 Kagawa
(Continued)

FOREIGN PATENT DOCUMENTS

CN 111286079 A 6/2020
GB 2463017 A 3/2010
(Continued)

*Primary Examiner* — Elizabeth M Imani
(74) *Attorney, Agent, or Firm* — Gregory Finch; Finch Paolino, LLC

(57) ABSTRACT

A system, apparatus, composition and methods for producing a modular, ultra-thin, ultra-lightweight thermal camouflage, thermal signature mitigation and thermal insulation system. The thermal management system may comprise one or more composite layers or combinations of ultra-thin and ultra-lightweight non-woven stealth coated substrates. Each composite layer may be coated with specific components to create different thermal camouflage through a biomimicry application process of absorbance, reflective, protective layering, thermal signature mitigation, and/or thermal insulation system capabilities. Layers can be combined to enable dynamic stealth camouflage tunable performances of reflectivity, transmission, emissivity, or absorption in selective visible, near infrared, and infrared wavelength bands whereby each substrate has a unique EM wave propagation control or thermal signature mitigation characteristics. Embodiments enable thermal camouflage, thermal signature mitigation, and thermal insulation solutions that are adaptable to specific battlefield scenarios or environmental requirements.

19 Claims, 8 Drawing Sheets

(56) References Cited

U.S. PATENT DOCUMENTS

| | | | | |
|---|---|---|---|---|
| 11,081,802 | B2 | 8/2021 | Mejean et al. | |
| 2004/0051082 | A1* | 3/2004 | Child | D06M 15/248 252/500 |
| 2009/0111345 | A1 | 4/2009 | Panse et al. | |
| 2013/0137324 | A1 | 5/2013 | Tang | |
| 2014/0248814 | A1 | 9/2014 | Handermann | |
| 2018/0100256 | A1 | 4/2018 | Handermann et al. | |
| 2019/0017785 | A1* | 1/2019 | Morag | B32B 5/06 |
| 2019/0100870 | A1* | 4/2019 | Ortega | B32B 5/022 |
| 2020/0227833 | A1 | 7/2020 | Hiroi et al. | |
| 2021/0119343 | A1 | 4/2021 | Fu et al. | |
| 2021/0260850 | A1 | 8/2021 | Jin et al. | |
| 2021/0324254 | A1 | 10/2021 | Li et al. | |

FOREIGN PATENT DOCUMENTS

| | | | | |
|---|---|---|---|---|
| IL | 273905 | A | 5/2020 | |
| WO | 02080201 | A1 | 10/2002 | |
| WO | WO-03091652 | A2 * | 11/2003 | F41H 3/00 |

* cited by examiner

800

OMNI-SPECTRAL THERMAL CAMOUFLAGE, SIGNATURE MITIGATION AND INSULATION APPARATUS, COMPOSITION AND SYSTEM

FIELD

The present disclosure relates to the field of non-woven textiles systems for use in ultra-thin and ultra-lightweight omni-spectral thermal camouflage, thermal signature mitigation, and thermal insulation applications.

BACKGROUND

The protection and survival of troops on the battlefield is a vital aspect of conducting combat operations. Thermal camouflage is one of the most effective ways to increase the protection and survival of troops in what is becoming peer-to-peer level potential conflicts. Thermal camouflage is a method for assimilating into the environment in response to an interrogation wavelength of a detector which may correspond to visible, infrared (IR), thermal IR (TIR) and microwave wavelengths. The rapid development of reconnaissance measures, detection, and targeting technologies (in particular, BAND I, II, and III) hinder the ability of troops to operate in a wide spectrum of electromagnetic radiation. It is becoming increasingly necessary to continually advance the effectiveness of various means of thermal camouflage on clothing and in garments, shelters, sleep systems, camouflage nets and more, with a focus on BAND III TIR (8-14 μm) detection of human, warm vehicle and aircraft skins. This poses a significant challenge, in terms of the properties of the materials used, design optimization, and cost-effective fabrications of modern thermal camouflage, signature management, and insulation systems to optimize wearables as well as overhead thermal signature mitigation textiles that addresses the current omni-spectral detection threats for soldiers, equipment, and facilities on the modern battlefield or military stationary assets. Examples include thermal camouflage for extreme heated objects in the BAND I range of detection for heat seeking missiles (1-3 μm) on heat plumes and engine internals to less heated objects in BAND II (3-5 μm) with generators or artificially heated shelters.

Camouflage fabrics are used in producing military uniforms that reduce the daytime visibility of the wearer, but wearable camouflage against detection by long-wave sensors (thermal infrared or microwave radar) has yet to be widely deployed with success due to the proximity of a single layer of fabric against the skin. Fabrics used in clothing, uniform, and gear play a critical role in breaking up visible signature and regulating heat transfer. Conventional thermal and radar camouflage materials known in the art tend to be too heavy for use by ambulatory foot soldiers and do not allow sufficient ventilation or heat exchange to maintain a reasonable level of comfort and thus generally are not practical for operational use.

The normal temperature of the skin body is about 34° C. and the human body releases radiation from the mid-infrared (IR) at a peak propagation of 9.5 micrometer (μm) which can be detected by various heat-sensing systems and thus can compromise stealth. Thermal imaging targeting systems may be designed to operate in spectral bandwidths that coincide with "atmospheric windows" in the range of 1-3, 3-5 or 8-12 μm. Thermal control is a technique developed by designing fabrics that can control among other areas in the TIR spectrum, the thermal transfer system of the human body temperature or thermal IR (TIR). The transfer of heat between the body or mechanical surface and the surrounding climate condition is completely dependent on several main factors such as ambient temperature, composition, conduction, IR reflection, air circulation, average radiant heating, moisture content, radiant exitance of the object's surface and clothing design. On the body, a fabric structure can influence heat and moisture transfer and hence thermal comfort, which can impact field longevity to maintain thermal equilibrium and mission success in cold environments and reflect UV/IR radiation (solar) away from the body or mechanical surface to stay cool (body or equipment) in hot environments.

The control of electromagnetic (EM) wave behavior and thermal emission are becoming increasingly important for stealth applications, as the expanded capabilities of thermal detection and targeting technologies increases and the growing threat of peer-to-peer or near peer conflict becomes more prevalent. Although many camouflaged garments, nets, tarps, or shelters are well suited to providing camouflaged properties to the warfighter in the visible region of light and to some extent in the near infrared region, many camouflage patterns lose their effectiveness at longer infrared wavelengths thus requiring further improvements in thermal signature mitigation. One of the sectors of developing equipment is the growing demand for NIR (Near-Infrared), SWIR (Short-wave Infrared), and LWIR (Long-wave Infrared) camouflage has led to the continuous effort to improve full spectrum technologies. Thermal IR (TIR) and Infrared (IR) absorption properties in these frequencies or wavelengths bandwidth as well as detection devices utilizing lasers or scanning devices operating in the frequency range from 0.01 nm to 10 nm (X-ray) and from 0.70 to 2.50 μm (NIR-MIR), which require a broken surface signature mitigation solution to affect electromagnetic (EM) wave transmission (e.g., duplicating the flocked surface of snow, velvet or and sub-surface diffusion). For another example, on high frequency mitigation, a microwave absorber can effectively absorb EM wave energy and convert EM energy into heat. Concealment of personnel and equipment from hostile observation often is essential during special warfare and reconnaissance activities and/or before making an effective coordinated strike. The task of concealment can be even more difficult with TIR imaging equipment being more available in the field. IR imaging equipment can indirectly measure the thermal profile of objects by the emission of the infrared signature in their field of view. Every material has a set of properties and "spectral fingerprints" consisting of absorptivity, reflectivity, and emissivity of electromagnetic radiation. However, conventional EM wave absorption materials have several drawbacks including heavy weight, reduced durability, complex manufacturing (expensive), rigidity (i.e., lacking in flexibility) and limited efficacy to fixed frequency bands or wavelengths. Composite materials and systems have been devised to meet these challenges. Composite materials allow convenient use on surfaces, good control over mechanical properties, and variation of EM properties with proper selection of matrix material and methods of manufacture with different inclusions of either dielectric, conductive or ferromagnetic particles. However, very thin and lightweight high-performance materials needed for incorporation into various omni-spectral thermal camouflage, thermal signature mitigation, see-through/semi-see-through, that can easily be carried or deployed in the field for warfighters to "problem solve" their signature equation with regards to movement, stationary position, weather, area of operation, terrain and enemy threat remain elusive in meeting the demands of today's and future stealth missions and concealment applications.

SUMMARY

The following presents a simplified summary of some embodiments of the invention to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An aspect of the present disclosure is a modular, scalable, ultra-thin, and ultra-lightweight thermal camouflage, thermal signature mitigation, and thermal insulation system. In various embodiments, the thermal management system may comprise one or more composite layers of ultra-thin and ultra-lightweight, non-woven substrates. In various embodiments, the ultra-thin and ultra-lightweight non-woven substrates may comprise a spun bond, thermal bond nano mesh, or a spun lace substrate. In various embodiments, one or more external surface of the said ultra-thin and ultra-lightweight substrates may be coated with one or more, thermal signature emission control conductive metal layer, conductive radar absorbing material (RAM) stealth coating, or fire-retardant (FR) mixture. In various embodiments, said conductive metal layer may be printed, pad applied (dipped), sprayed in a solid or broken pattern, preferably with one or more Faraday cage patterns. In various embodiments, one or more said coating layer may comprise a first conductive radar absorption material (RAM) coating layer and a second thermal signature emission control layer containing one or more spherical, non-spherical, non-encapsulated, polymeric encapsulated, metallic, magnetic, ferromagnetic, paramagnetic, superparamagnetic, diamagnetic, Barium, Boron Nitride, Barium Nitrate, Barium Sulfate, Hafnium, dot, particle, microparticle, or nanoparticle enabling EM wave propagation control through an object's surface and retarding human black body radiation emission. In accordance with certain aspects of the present disclosure, a "dot" comprises a polymeric microsphere comprising at least one metallic micro-nanoparticle encapsulated therein. In various embodiments, a metallic micro-nanoparticle comprises a magnetic, superparamagnetic, or diamagnetic iron oxide micro-nanoparticle. A metallic micro-nanoparticle may comprise one or more of magnetite, hematite, barium, hafnium, combinations thereof, and like elements or compounds. In various embodiments, one or more paramagnetic, micro-nanoparticles in the polymeric microsphere dots contain elements such as iron oxide, aluminum oxide, nickel and copper to provide electromagnetic wave propagation control and aid in subsurface diffusion, conduction, reflection, absorption, transmission, and multi-reflection. In various embodiments, one or more spherical polymeric dots encapsulating magnetite, barium sulfate, and/or hafnium micro-nanoparticles provide EM wave propagation control, including but not limited to subsurface diffusion, X-ray mitigation (opacity), reflection, absorption, transmission, and multi-reflection. In various embodiments, one or more said particle provides EM wave propagation control of an objects surface area spectral exitance including but not limited to, sub-surface EM wave diffusion (SSD), electrical conduction, reflection, absorption, transmission, heat movement and multi-reflection. In various embodiments, the individual ultra-thin and ultra-lightweight non-woven substrates may be combined to construct one or more dynamic layers of varying thermal camouflage, thermal signature mitigation, or thermal insulation performance. The high-performance thermal camouflage, thermal signature mitigation, and thermal insulation system comprising one or more stealth ultra-thin ultra-lightweight thermal substrates enables omni-spectral adaptable stealth applications.

An aspect of the present disclosure is a modular, scalable, ultra-thin, ultra-lightweight thermal camouflage, thermal signature mitigation, and thermal insulation system with adjustable performances. In various embodiments, the thermal management system may comprise one or more composite layers of ultra-thin and ultra-lightweight non-woven substrates constructed to achieve tunable performance achieved by selectively adjusting a low thermal mass substrate material (either non-woven or knit) photonic spectral exitance and by dynamic layering resulting in varying degrees of substrate reflectance, transmittance, emissivity, or absorbance properties. In one embodiment, one substrate may comprise a low thermal mass spun bond and transparent to semi-transparent first layer coated to achieve high transmission and layered sub-surface diffusion capabilities for thermal signature mitigation in the long infrared wavelength region and moderate EM wave transmission control to match the Earth albedo percent reflection.

In another embodiment, another substrate may comprise a semi-transparent nano mesh coated to achieve high transmission and layered sub-surface diffusion capabilities for thermal signature mitigation in the long infrared wavelength region. In yet another embodiment, a substrate may comprise a spun lace non-transparent thin micro insulator coated to achieve low EM wave transmission, high absorption, and optimal thermal insulation (Band III). In various embodiments, two or more layers of low thermal mass substrate may be combined to achieve TIR selective thermal emittance (tunable) performance by dynamic layering resulting in varying degrees of substrate thermal mass, diffusion reflectance, transmittance, emissivity, or absorbance properties. In various embodiments, two or more said spun bond, nano mesh, or spun lace substrates are combined, layer by layer, to achieve specific 2D textile or 3D knit camouflage or stealth performance specifications that are adaptable, adjustable, or tunable to specific battlefield scenarios, conditions, environments or missions.

Aspects of the present disclosure provide for methods for constructing a modular, scalable, ultra-thin and ultra-lightweight thermal camouflage, thermal signature mitigation, and thermal insulation system. In various embodiments, the methods may comprise one or more steps for coating one or more ultra-thin, ultra-lightweight thermal substrates with one or more electric conductive layer, thermal resistant, thermal conductive layer, or thermal reflectant (selective emission) pigment patterns to create one or more high-performance thermal camouflage, thermal signature mitigation and thermal insulation solutions. In various embodiments, the methods of printing, spraying, pad application, knife-over-edge coating may comprise one or more steps for combining one or more said individual stealth coatings on the thermal substrates by combining a lower conductive absorption layer, an upper reflective layer, and an outer protective layer to create plant structure mimicry in layering of chemistry and substrates. In various embodiments, the methods may comprise one or more steps for constructing one or more thermal substrates with specific individual or combined thermal or EM wave control performances of reflectivity, transmission, emissivity or absorbance. In various embodiments, the methods may comprise one or more steps for constructing one or more thermal substrates with specific individual or combined layers possessing varying degrees of tunable reflectivity, transmission, emissivity, or absorbance.

In various embodiments, the methods may comprise one or more steps for combining one or more said individual thermal substrates to create one or more dynamic thermal or EM wave control performances. In various embodiments, the methods may comprise one or more steps to create one or more high-performance thermal camouflage, thermal signature mitigation, and/or thermal insulation solutions, including but not limited to, a stealth coating, veil, shell, tent, military uniform, thermal nest, netting, insulation, or the like, using one or more ultra-thin and ultra-lightweight non-woven substrates. In various embodiments, the methods may comprise one or more steps for creating one or more thermal solutions using at least one spun bond, thermal bond, spun lace, quilting, or needling process. These methods enable the construction of one or more modular, scalable, adaptable and lightweight high-performance thermal camouflage, thermal signature mitigation, and/or thermal insulation system.

Further aspects of the present disclosure include a stealth material composition, comprising a non-woven shell layer comprising one or more spun bond fibers; a thermal absorption layer disposed on the non-woven shell layer, the thermal absorption layer comprising a radar absorbing material comprising a conductive ink disposed on the non-woven shell layer, the conductive ink comprising a mixture of graphite particles and a binder; and a protective coating layer disposed on the thermal absorption layer, the protective coating layer comprising a polymer resin.

In accordance with certain embodiments of the stealth material composition, the one or more spun bond fibers may comprise one or more conductive fibers comprising one or more of graphite, graphite oxide and boron nitride. In certain embodiments, the conductive ink is disposed on the non-woven shell layer according to a screen-printed pattern. The screen-printed pattern may be configured as a Faraday cage pattern. The screen-printed pattern may comprise a grid comprising one or more rows comprising a plurality of random or ordered apertures. Each of the apertures may comprise a diameter in the range of 0.5 millimeters to 2.0 millimeters. In certain embodiments, the plurality of random or ordered apertures are arranged to have a periodic separation distance in the range of 1.0 millimeters to 3.0 millimeters.

In accordance with certain embodiments of the stealth material composition, the one or more spun bond fibers are constructed from one or more fiber type selected from the group consisting of polyester, polyimide and polypropylene. The screen-printed pattern may comprise a broken pattern or a random pattern. In certain embodiments, the conductive ink comprises reflective aluminum particles or aluminum flakes. The conductive ink may comprise a near-infrared reflective pigment.

Still further aspects of the present disclosure include a stealth material composition, comprising a mesh layer comprising a semi-transparent mesh; a thermal absorption layer disposed on the mesh layer, the thermal absorption layer comprising a radar absorbing material comprising a conductive ink disposed on the mesh layer, the conductive ink comprising a mixture of graphite particles and a binder; and a protective coating layer disposed on the thermal absorption layer, the protective coating layer comprising a polymer resin. In certain embodiments, the mesh layer is constructed of a 20-denier multifilament polyester material. The mesh layer may be constructed of a multifilament polyester material having a weight in the range of 0.8-1.05 ounces per square yard. The mesh layer may be constructed of a multifilament polyester material with a course count in the range of 42-48 threads per inch and may comprise a wale count in the range of 26-32 threads per inch.

Still further aspects of the present disclosure provide for a stealth material composition, comprising a micro substrate layer comprising a bicomponent fiber; a thermal absorption layer disposed on the micro substrate layer, the thermal absorption layer comprising a radar absorbing material comprising a conductive ink disposed on the micro substrate layer, the conductive ink comprising a mixture of graphite particles and a binder; and a protective coating layer disposed on the thermal absorption layer, the protective coating layer comprising a polymer resin. In accordance with certain embodiments, the micro substrate layer comprises a bicomponent polyester. The micro substrate layer may comprise a weight in the range of 16.0 grams per square yard to 17.0 grams per square yard. The micro substrate layer may comprise a thickness in the range of 9.0 millimeters to 11.0 millimeters. The micro substrate layer may comprise a machine direction tensile strength in the range of 1000 grams per inch to 1200 grams per inch.

BRIEF DESCRIPTION OF DRAWINGS

The above and other objects, features and advantages of the present disclosure will be more apparent from the following detailed description taken in conjunction with the accompanying drawings, in which.

DETAILED DESCRIPTION

Figure 1:
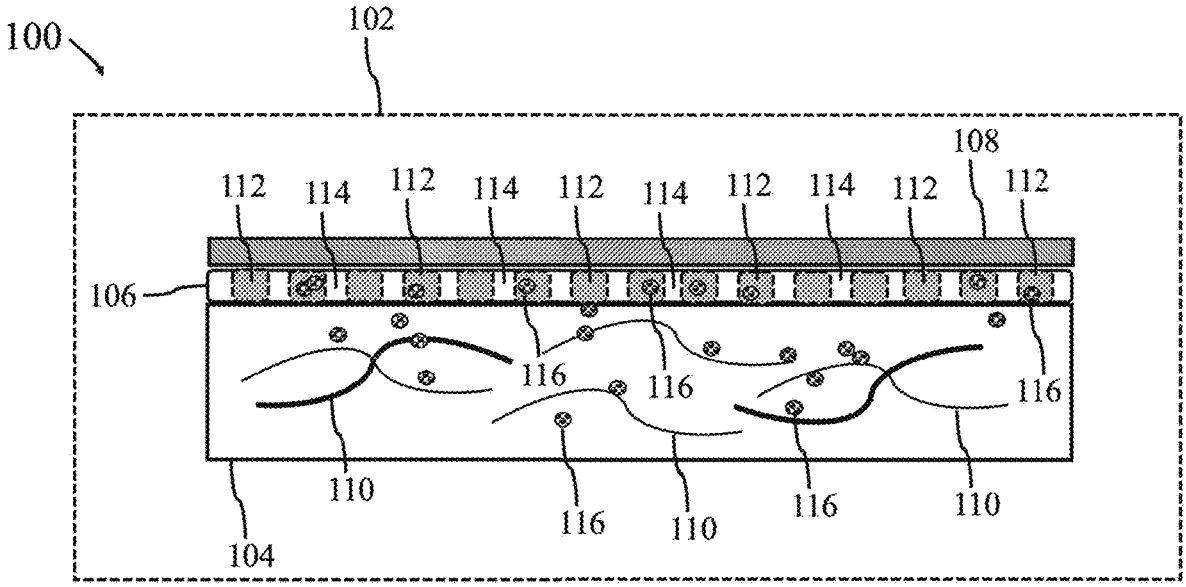
FIG. 1 is an illustration of an ultra-thin, ultra-lightweight thermal camouflage, thermal signature mitigation, and thermal insulation system and composition, in accordance with certain aspects of the present disclosure.

It should be appreciated that all combinations of the concepts discussed in greater detail below (provided such concepts are not mutually inconsistent) are contemplated as being part of the inventive subject matter disclosed herein. It also should be appreciated that terminology explicitly employed herein that also may appear in any disclosure incorporated by reference should be accorded a meaning most consistent with the concepts disclosed herein.

It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes. The present disclosure should in no way be limited to the exemplary implementation and techniques illustrated in the drawings and described below.

Where a range of values is provided, it is understood that each intervening value, to the tenth of the unit of the lower limit unless the context clearly dictates otherwise, between the upper and lower limit of that range and any other stated or intervening value in that stated range is encompassed by the invention. The upper and lower limits of these smaller ranges may independently be included in the smaller ranges, and are also encompassed by the invention, subject to any specifically excluded limit in a stated range. Where a stated range includes one or both endpoint limits, ranges excluding either or both of those included endpoints are also included in the scope of the invention.

As used herein, the term "includes" means includes but is not limited to, the term "including" means including but not limited to. The term "based on" means based at least in part on.

As used herein, the term "omni-spectral" means, but is not limited to, the wavelength range of X-ray, UV, visible, near infrared (NIR), infrared (IR), mid-range IR (MWIR), SWIR, LWIR, far IR, millimeter, radar radio waves (i.e., $10^{-10}$ to $10^{8}$ meter).

As used herein, the term "black body" radiation means the thermal electromagnetic radiation within or surrounding a body in thermodynamic equilibrium with its environment, emitted by a black body (an idealized opaque, non-reflective body).

As used herein, the term "grey or gray body" means an object with an emissivity less than unity (i.e., less than 1) and the same at all wavelengths, by comparison with a black body that has unit emissivity or emissivity equal to 1, at all wavelengths.

As used herein, the term "Gray Body Diffusion" means an object possessing a relatively similar emissivity through the thermal IR (TIR) spectra.

As used herein, the term "tunable" is loosely defined as first creating a straight-line gray body diffusion through the three thermal IR bandwidths on a low thermal mass non-woven substrate through the select application of stealth coatings (biomimicry).

As used herein the term "stealth coating" means, but is not limited to, a combination of one, two, or more layers of stealth polymer ink applications to the surface of a substrate.

As used herein, the term "nonwoven" or "non-woven" is a broad term encompassing almost any fabric or textile which is made without weaving fibers together (i.e., loom).

As used herein, the term "spun lace" is the process of producing an entanglement of and/or stealth coated fibers (metallic conductive fibers) or materials by means of heavy water jets at very high pressures through jet orifices with very small diameters.

As used herein, the term "spun bonding" is a process for forming nonwoven fabrics by bonding continuous-filament synthetic fibers and/or stealth coated fibers (above) immediately after extrusion.

As used herein, the term "needle punching" is a mechanical bonding achieved by entangling of fibers with barbed needles, set into a board, which penetrate the web and then recede.

As used herein, the term "Faraday cage" is a volume surrounded by conductive walls with openings or holes capable of neutralizing an external EM field or shielding against an external EM field, such openings or holes having diameters that are much smaller than a specific wavelength so that there is no EM field coupling through the openings or quilting.

As used herein, the term "Faraday cage pattern" is a pattern of opening or hole of a Faraday cage. An example is the metal screen with holes on the door of a microwave oven. The screen keeps the microwaves contained within the oven while allowing light, with its much shorter wavelength, to pass through. This pattern assists in electrical conduction/TIR absorption of the stealth coating and assists in transmission.

As used herein, "exemplary" means serving as an example or illustration and does not necessarily denote ideal or best.

Certain objects and advantages of the present disclosure include a thermal signature apparatus and system that allows the individual warfighter to build modular and scalable stealth compositions, including lightweight, layered, thermal signature mitigating compositions (e.g., a thermal nest above and/or around to hide from space, airborne, land based thermal observation/targeting mechanisms), that are adaptable to varying battle environments.

Exemplary embodiments of the present disclosure provide one or more system, apparatus, and methods for producing a modular, ultra-thin, ultra-lightweight thermal camouflage, thermal signature mitigation, and thermal insulation system. The thermal management system may comprise one or more composite layers of ultra-thin and ultra-lightweight non-woven stealth coated substrates. Each composite layer may be coated with specific components to create different thermal camouflage through a biomimicry application process of absorbance, reflective, protective layering, thermal signature mitigation, and/or thermal insulation system capabilities. The layers on the individual substrates may be combined to enable dynamic stealth camouflage tunable performances of reflectivity, transmission, emissivity, or absorption in selective visible, near infrared, and infrared wavelength bands whereby each substrate has a unique EM wave propagation control or thermal signature mitigation characteristics. The system enables thermal camouflage, thermal signature mitigation, and thermal insulation solutions adaptable to specific battlefield scenarios or environmental requirements. The systems expand the options for meeting the demands of today and future stealth missions.

Reconnaissance measures such as radar uses an emitting element to transmit a radiation beam. When such beams encounter an object, they are reflected by the object and returned to the radar. The radar receiver receives the reflected radiation, which is subjected to time analysis (to determine the distance to the detected object) and amplitude-phase analysis (to determine the type of object detected). This mode of operation of radar devices means that the only effective countermeasure is to minimize reflected radiation, resulting in either a lack of detection or, should detection occur, incorrect identification of the object. It is generally accepted that radars operate in the range of electromagnetic radiation, mostly in the centimeter and millimeter wave spectrum. However, battlefield radar and tracking radars work in different wavelengths, from 1 to 20 GHz, 35 GHz, and 94 GHz.

Camouflage in the radar range focuses on at least two aspects: reducing the radar cross section (RCS) of objects so that a minimal proportion of the radiation emitted by the radar returns to it as the result of being reflected from the object; deformation/blurring of the radar signature of the object camouflaged to eliminate or change the details of the radar signature which allow recognition/identification of the object. Another approach is to use microwave absorbers.

The absorption of electromagnetic (EM) wave radiation and propagation is a process by which the energy of an EM wave is turned off and then transformed into other energies by interference, which EM wave cannot reflect or transmit through material. Ideal EM wave absorbing materials should have two basic properties: (1) the intrinsic impedance of the material is equal to the impedance of the free space (impedance matching) and (2) the EM wave in the material is rapidly attenuated. These conditions require strong magnetic and/or dielectric loss exhibition.

Electromagnetic energy/wave consists of a magnetic (H-field) and electric (E-field) component perpendicular to each other and propagates at right angles to the plane containing the two components. The ratio of E to H is defined as the wave impedance ($Z_w$, in ohms Ω) and depends on the type of source and the distance from the source. Large impedances characterize electric fields and small impedances characterize magnetic fields. Far from the source, the ratio of E to H remains constant and equal to 377Ω, the intrinsic impedance of free space.

A radar absorbing material (RAM) reduces the energy reflected back to the radar by means of absorption. The main requirements are an effective EM wave impedance and good attenuation at the surfaces of a RAM that result in a good match for the incoming signal once it penetrates the material. RAMs can be categorized into two types: dielectric and magnetic absorbers, which means that the absorption is primarily due to their dielectric and magnetic characteristics, respectively.

The amount of attenuation offered by an absorber depends on three mechanisms. The first is usually a reflection of the wave from the shield/absorber. The second is an absorption of the wave into the absorber as it passes through the absorber. The third is due to the re-reflections, i.e., the multiple reflections of the waves at various surfaces or interfaces (e.g., air, material) in the shield/absorber. The reflection loss is a function of the ratio $S_r/M_r$, whereas the absorption loss is a function of the product $S_r$ times $M_r$, where $S_r$ is the electrical conductivity of the absorber relative to copper and $M_r$ is the magnetic permeability of the shield/absorber relative to free space. The EMI shielding/absorption efficiency (SE), reported as reduction of transmitted wave power, includes the shielding effects due to absorption, reflection, and multiple reflections. Due to multiple reflections inside of a shielding/absorbing material, there can also be after-effects like secondary reflection and secondary transmission.

Polymer fabrics or matrices are generally non-magnetic and do not make any magnetic contribution to EM wave attenuation. The absorption by the dielectric materials depends on dielectric loss mechanisms, such as electronic/atomic polarization, orientation (dipolar) polarization, ionic conductivity, and interfacial or space charge polarization. Magnetic loss mechanisms include hysteresis loop (from irreversible magnetization, which is negligible in a weak applied field), domain wall resonance (which usually occurs in the frequency range 1-100 MHz), Natural Resonance, and Eddy current losses. According to Poynting's theorem, there is a directional energy flux density of an EM wave (Poynting vector) that is defined as the cross product of the magnetic field vector and the electric field vector. This means that attenuation of EM waves requires not only electronic contribution, but magnetic as well. However, both dielectric and magnetic materials have relatively low absorption when they are used independently. Therefore, it is ideal to enhance absorption characteristics when dielectric materials are coated or blended with micro-nanomaterials such as metallic flakes or particles.

Spectral absorption features observed in the visible to short-wave infrared wavelength region result from several distinct processes. In the spectral range from 0.4 to approximately 1.2 micrometer (μm), absorption features are produced mainly by energy level changes in the valence electrons of transition metals, by paired excitations of metal cations, or by charge transfer between metal cations and their associated ligands. Intervalence charge transfer (IVCT) transitions in the visible and near-IR region are transitions in which an electron, through optical excitation, is transferred from one cation to a neighboring cation. Compounds containing an element in two different oxidation states, mixed valence compounds, often show intense absorption in the visible region which can be attributed to IVCT transitions.

Molecular vibration processes generate absorption features in the SWIR (1.3-2.5 μm) and the long infrared (LWIR) wavelength range. Common absorption features in the SWIR wavelength range include 2.18-2.22 μm bands related to Al—O—H combination bands in aluminous materials such as aluminum flakes. In the mid- and far-IR, away from inter-band transitions, coupling to collective oscillations of free-carriers, called plasmons, and vibrations of the crystal lattice in polar materials can significantly affect the permittivity of a material. Hafnium dioxide ($H_fO_2$), the most stable form, is a polar crystal with strong absorption from the IR active optical phonon modes. Boron Nitride (BN) is synthesized as white powders and preferentially grows in the hexagonal structure, similarly to graphite. The transmission spectrum for BN deposited on a germanium multiple internal reflection (MIR) plate have been measured from 2.5 to 50 μm by spectrophotometry. In addition, absorption studies of BN-on-quartz have also been made in the 0.19 to 3.2 μm range. Several absorption bands are known in the transmission spectrum for BN-on-Ge. The peak at 6.9 μm is due to the B—N bending mode. The maximum near 6.5 μm is associated with N=0. The B—H vibration is observed at 4 μm. A broad structure in the vicinity of 2.9 μm results from 0-H. Similarly, spectroscopic measurements of Barium Nitrate show infrared absorption bands at 4.2, 5.6, 7, 7.4, 11.6, and 13.6 μm. The absorption properties of these micro-nano particles make them ideal for incorporation into high performance thermal camouflage, thermal signature mitigation, and thermal insulation solutions for stealth applications.

An aspect of the present disclosure is a modular, scalable, ultra-thin, and ultra-lightweight thermal camouflage, thermal signature mitigation, and thermal insulation system. Referring now to FIG. 1, an illustration 100 of an ultra-thin, ultra-lightweight thermal camouflage, thermal signature mitigation, and thermal insulation system is shown, according to various embodiments. For illustrated purposes not every element is labelled in the diagram, but their function is equivalent to a corresponding labeled one. In various embodiments, system 102 comprises at ultra-thin and ultra-lightweight non-woven shell 104, an EM wave thermal absorption layer 106, and a protective coating layer 108. In various embodiments, the non-woven shell 104 may comprise a fiber type, including but not limited to, polyester, polyimide (e.g., Nylon-6,6), or polypropylene. In various embodiments, the non-woven shell 104 may comprise one or more trapped spun bond fiber 110 of varying length and diameter. In a preferred embodiment, non-woven shell 104 is fabricated from polyester, preferably Lutradur (Freudenberg Spunweb Company, Durham, N.C.) with a weight of 30 to 40 gram per square meter (gsm) for light weight and semi-transparency enabling electromagnetic wave (EM) sub-surface diffusion (SSD). In a preferred embodiment, non-woven shell 104 is fabricated with a thickness of less than or equal to 1 millimeter to create a transparent ultra-thin and ultralight structure with trapped spun bond fibers resembling plant leaf structure mimicry while providing strength. In various alternative embodiments, non-woven shell 104 is fabricated using conductive fibers coated or extruded with graphite, graphite oxide and/or boron nitride. In various embodiments, thermal absorption layer 106 may comprise one or more screen-printed pattern 112 forming one or more resulting hole 114. In various embodiments, the screen-printed pattern comprises a conductive ink containing a radar absorbing material (RAM) mixture of conductive graphite (95%) and a binder (5%). The binder can be 14-V-3138 (Acrylic Latex, Textile Rubber & Chemical, Indian Trail, N.C.) which is an acrylic emulsion used in the textile industry as an all-purpose binder mostly for printing and coating. In various embodiments, the ink G-RAM mixture may contain one or more graphite particle 116 and boron nitride or barium nitrate particle to serve as a combination RAM-X-ray-IR stealth coating. The ink mixture may comprise a varying percent of graphite or graphite particles and boron nitride, preferably 85% or less graphite and between 2-15% boron nitride. In various embodiments, the conductive graphite can be made synthetically or natural flakes of varying particle sizes. In various embodiments, the synthetic conductive graphite particles may comprise a minimum crystallite height of 100 nm, surface grain ranging from 20 to 45 $cm^2$ per gram, and particles having a diameter D10 between 2-4 μm, D50 between 7.5 to 12 μm, and/or D90 between 10 to 20 μm. In various embodiments, the natural conductive graphite flakes may comprise particles with diameter D50 of between 4 to 6 μm and diameter D90 approximately 10-15 μm. In various embodiments, the synthetic or natural conductive graphite particle or flakes may be produced in various percent formulations ranging 10 to 60% combined with varying percent of Ash ranging from 0.05% to 5% and varying moisture content ranging from 0.1% to 2%. In a preferred embodiment, one or more said graphite, boron nitride, or barium nitrate are monodispersed particles having a uniform non-limiting diameter of 10 μm to 20 μm to achieve gray body diffusion or emissivity performance. In an alternative embodiment, the ink mixture may comprise reflective aluminum or flakes combined with one or more selective NIR-reflective pigment. In various embodiments, the ink mixture may comprise one or more spherical, non-spherical, non-encapsulated, polymeric encapsulated, metallic, magnetic, ferromagnetic, paramagnetic, superparamagnetic, diamagnetic, barium, boron nitride, barium nitrate, barium sulfate, hafnium, dot, particle, microparticle, or nanoparticle (as described above). The dot, particle, microparticle, or nanoparticle particles may enable EM wave propagation control and retarding human black body radiation emission. In various embodiments, one or more said particle provides EM wave propagation control, including but not limited to, sub-surface EM wave diffusion (SSD), electrical conduction, reflection, absorption, transmission, and multi-reflection. In a preferred embodiment, screen-printed pattern 112 is one or more Faraday cage pattern printed to provide a conductive circuit network structure within system 102. In various embodiments, the printed patterns create one or more resulting hole 114 to enable EM wave propagation control, airflow, and limit heat retention or conduction. In various alternative embodiments, one or more graphite particle 116 can diffuse into non-woven shell 104 containing said conductive fibers to make electrical conduction between one or more graphite particle and one or more conductive carbon fiber. In various embodiments, protective coating layer 108 may comprise low thermal resistant polymer resin to provide a protective shell, including but not limited to, Polydimethylsiloxane (PDMS). In various embodiments, coating layer 108 may comprise melamine or similar compound having low thermal resistance and fire-retardant (FR) properties. In one embodiment, coating layer 108 may comprise Flamex 1916 (Unichem, Inc, Haw River, N.C.) which is a high phosphorous containing flame retardant. In various embodiments, coating layer 108 confers water resistance and windproof properties to system 102. The resulting system 102 serves as a first line layer with high transmission and layered sub-surface diffusion capabilities for thermal signature mitigation in the long infrared wavelength region. The system 102 may be combined with another system to construct one or more dynamic layers of varying thermal camouflage, thermal signature mitigation, or thermal insulation performance thus creating solutions for omni-spectral adaptable stealth applications.

Figure 2:
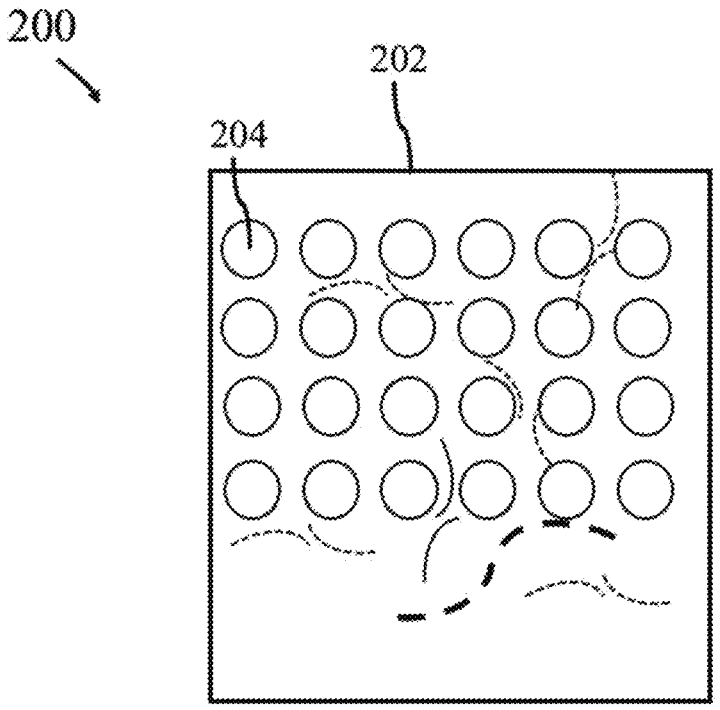
FIG. 2 is an illustration of a conductive Faraday cage pattern, in accordance with certain aspects of the present disclosure.

Referring now to FIG. 2, an illustration 200 of a conductive Faraday cage pattern in accordance with various embodiments is shown. As described, system 102 of FIG. 1 comprises a layer, show here as layer 202, equivalent to thermal absorption layer 106 of FIG. 1. In various embodiments, one or more Faraday cage pattern is screen-printed to create a conductive grid. In one embodiment, the conductive grid comprises a pattern of one or more rows of holes 204 on top of the ultra-thin and ultra-lightweight non-woven shell 104 of FIG. 1, containing one or more trapped spun fibers (shown as dash structures). In various embodiments, the conductive grid is printed having holes of non-limiting diameter between 0.5 mm to 2.0 mm, preferably 1.0 mm in diameter, and a periodic separation non-limiting distance of approximately between 1.0 mm to 3.00 mm. In various alternative embodiments, said conductive grid may contain alternative opening or porous geometries and varying dimensions, including but not limited to oval, elliptical, square, rectangular, or hexagonal arranged in a random or ordered pattern. In various alternative embodiments, the screen-printed pattern may comprise a broken pattern with random open areas; for example, like pine needles. The one or more opening, hole, or porous geometry allows transmission and breathability and limits heat retention or conduction resulting in a plant structure mimicry.

Figure 3:
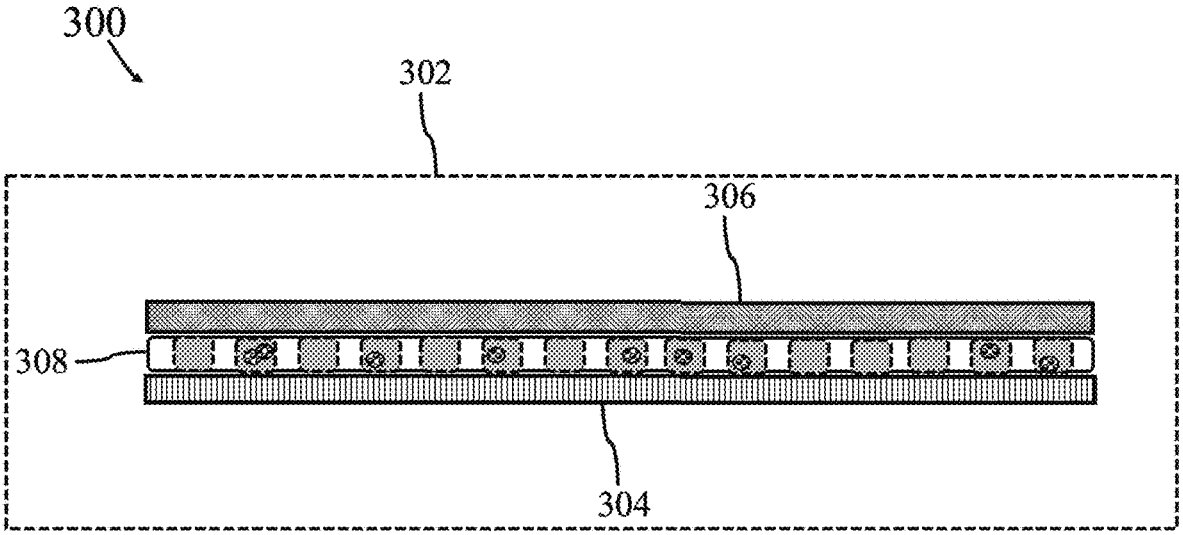
FIG. 3 is an illustration of a nano mesh substrate within a thermal camouflage, thermal signature mitigation, and thermal insulation system and composition, in accordance with certain aspects of the present disclosure.

An aspect of the present disclosure includes a modular, scalable, ultra-thin, ultra-lightweight thermal camouflage, thermal signature mitigation, and thermal insulation system with adjustable performances achieved through combining the functions of one or more dynamic layers. In at least one layer, a semi-transparent nano mesh substrate is fabricated and coated to achieve moderate EM wave transmission control to match the Earth albedo percent reflection. Referring now to FIG. 3, an illustration 300 of a nano mesh substrate is shown, according to various embodiments. In accordance with certain embodiments, nano mesh substrate 302 comprises a semi-transparent nano mesh 304, an EM wave thermal absorption layer 306, and a protective coating layer 308. In a preferred embodiment, nano mesh 304 comprises a 20-Denier multifilament polyester weighing approximately 0.8-1.05 ounce per square yard and with a thickness of between 0.007-0.011 inch. In yet another preferred embodiment, nano mesh 304 comprises a 20-Denier multifilament polyester with a course count of approximately 42-48 threads per inch and a Wale count of approximately 26-32 threads per inch. In various embodiments, nano mesh 304 may be spun laced or carded, cross-lapped, and calendered to even out one or more of its dimensions. In various embodiments, nano mesh 304 is fabricated with a first thermal absorption layer 306 whereby the composition, features, characteristics, and dimensions are similar to or equivalent to layer 106 of FIG. 1 achieve ultra-thin and ultra-lightweight properties. In various embodiments, nano mesh 304 is then fabricated with second protective coating layer 308 whereby the composition, features, characteristics, and dimensions are similar to or equivalent to layer 108 of FIG. 1 achieve ultra-thin and ultra-lightweight properties. In various embodiments, substrate 302 may be combined with system 102 of FIG. 1 to meet the performance specification of a thermal solution for a stealth application. In alternative embodiments, two or more substrate 302 may be combined to meet the performance specification of a thermal solution for a stealth application. In various embodiments, two or more substrate 302 are combined, layer by layer, to achieve specific 2D textile or 3D knit camouflage or stealth performance specifications that are adaptable, adjustable, or tunable to specific battlefield scenario, condition, environment, or mission.

Figure 4:
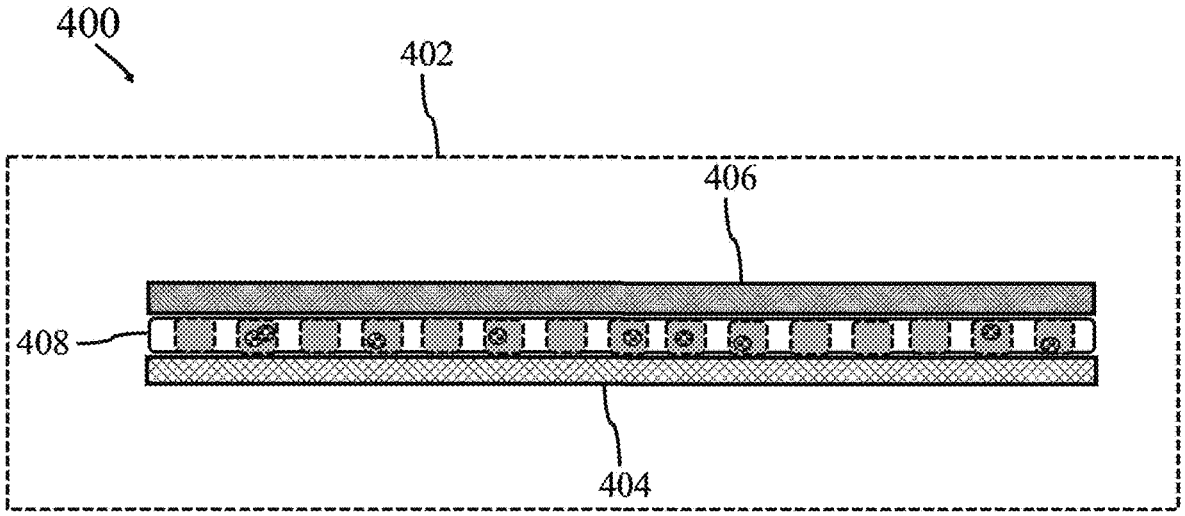
FIG. 4 is an illustration of a micro insulator substrate within a thermal camouflage, thermal signature mitigation, and thermal insulation system and composition, in accordance with certain aspects of the present disclosure.

An aspect of the present disclosure is a modular, scalable, ultra-thin, ultra-lightweight thermal camouflage, thermal signature mitigation, and thermal insulation system with adjustable performances achieved through combining the functions of one or more dynamic layers. In a third layer, a non-transparent thin micro insulator is coated to achieve low EM wave transmission, high absorption, and optimal thermal insulation. Referring now to FIG. 4, an illustration 400 of a thin micro insulator is shown. In accordance with certain embodiments, micro insulator 402 comprises a micro substrate 404, an EM wave thermal absorption layer 406 and a protective coating layer 408. In a preferred embodiment, micro substrate 404 comprises a biocomponent polyester with a weight basis in the range of 16.0 grams per square yard to 17.0 grams per square yard; and more preferably a weight basis of approximately 16.7 gram per square yard. In a preferred embodiment, micro substrate 404 comprises a biocomponent polyester with a with a thickness in the range of 9.0 millimeters to 11.0 millimeters; and more preferably, approximately 10 mils. In yet another preferred embodiment, micro substrate 404 comprises a thermal bonded biocomponent polyester with an MD tensile strength in the range of 1000 grams per inch to 1200 grams per inch; and more preferably, 1100 grams per inch. In various embodiments, micro substrate 404 is fabricated with a first thermal absorption layer 406 whereby the composition, features, characteristics, and dimensions are similar or equivalent to layer 106 of FIG. 1 to achieve ultra-thin and ultra-lightweight properties. In various embodiments, micro substrate 404 may be fabricated with second protective coating layer 408 whereby the composition, features, characteristics, and dimensions are similar or equivalent to layer 108 of FIG. 1 to achieve ultra-thin and ultra-lightweight properties. In various embodiments, micro insulator 402 may be combined with system 102 of FIG. 1 and/or nano mesh substrate 302 of FIG. 3 to meet the performance specification of a thermal solution for one or more stealth applications. In alternative embodiments, two or more micro insulator 402 may be combined to meet the performance specification of a thermal solution for a stealth application. In alternative embodiments, one or more micro insulator 402 may be combined with one or more system 102 of FIG. 1 and/or one or nano mesh substrate 302 of FIG. 3 to meet the performance specification of a thermal solution for a stealth application. The arrangement of the layers can be either layer by layer, side by side and/or fully or partially overlapping and may comprise a combination or a permutation of each system, nano mesh substrate, and/or micro insulator. The combination of one or more said individual thermal substrates can create a plant structure mimicry. The combination enables the tailoring, adjusting, varying, or fine-tuning of the thermal or EM wave control performances of reflectivity, transmission, emissivity, or absorbance as a thermal solution of a stealth application. In various embodiments, said arrangement enables the modular, scalable, ultra-thin, ultra-lightweight thermal camouflage, thermal signature mitigation, and thermal insulation system to achieve specific 2D textile or 3D knit camouflage or stealth performance specifications that are adaptable, adjustable, or tunable to specific battlefield scenario, condition, environment, or mission.

Figure 5:
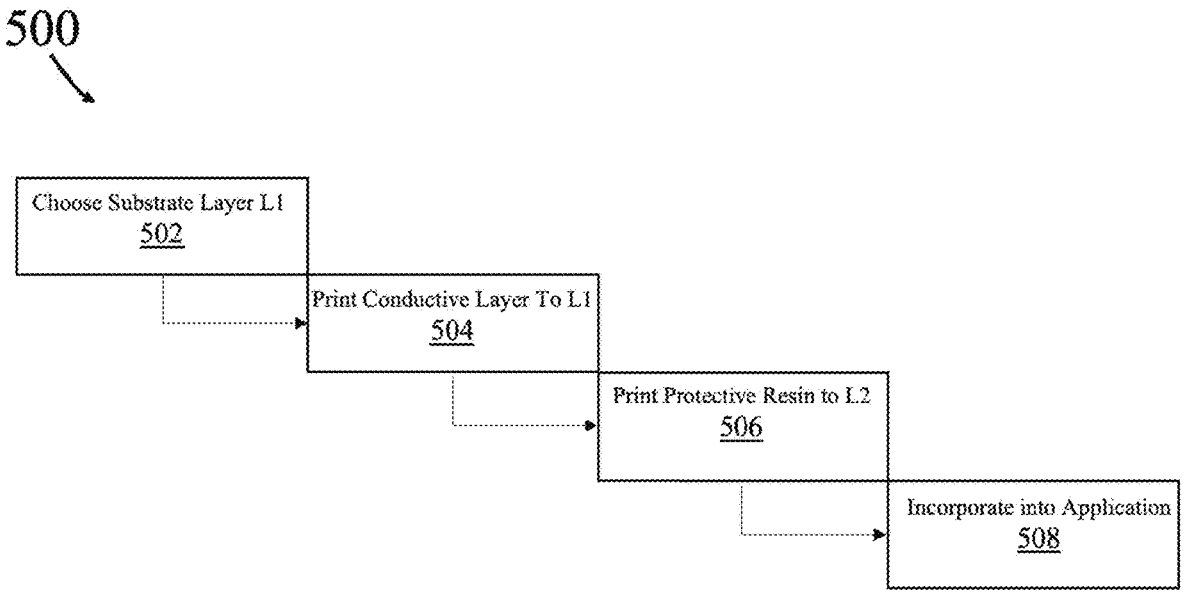
FIG. 5 is a flow chart of the method of fabricating a thermal insulation system and composition, in accordance with certain aspects of the present disclosure.

Certain aspects of the present disclosure provide for methods for constructing a modular, scalable, ultra-thin and ultra-lightweight thermal camouflage, thermal signature mitigation and thermal insulation system. Referring now to FIG. 5, a flow chart 500 of the method of fabricating a thermal insulation system is shown. In accordance with various embodiments, the method comprises a first step 502 of selecting a substrate layer (L1); for example, layer 104 of FIG. 1. In alternative embodiments, L1 may be layer 304 of FIG. 4 and/or layer 404 of FIG. 4. In a second step 504, a conductive Faraday cage pattern layer (L2) (e.g., layer 106 of FIG. 1) is printed on top of L1 using the composition, features, characteristics, and dimensions of layer 106 of FIG. 1. In a third step 506, a protective layer (L3) (e.g., layer 108 of FIG. 1) is printed on top of L2 using the composition, features, characteristics, and dimensions of layer 108 of FIG. 1. In various embodiments, one or more ink mixture for L2 or protective layer resin mixture for L3 is prepared by adding the weighed chemical in, for example, the following order (first to last): water, binder, reflective ink, FR chemistry, pigments, block-out and thickener. An exemplary reflective ink mixture may comprise 41% water, 3% Melamine resin, 10% binder, and 30% pigment to form a water or wind resistant coating layer. The ingredients are mixed, and the viscosity is adjusted to be between 12000-14000 cp. In a final step 508, the resulting thermal solution is incorporated into a stealth application, in accordance with various aspects of the present disclosure. In various embodiments, a stealth application may include, but is not limited to, a thermal camouflage, thermal signature mitigation, thermal veil insulation, or thermal wear applications, including a uniform, blanket, emergency blanket, tent, garment, sleeping bag, backpack, textile, fabric, assault pack, rucksack, netting, insulation, articles of clothing, uniform, tent, tent liner, sleep system, tarp, shell, blanket, net, bevy, cocoon, helmet cover, pack cover, throw, laminate, ULCANS, reversible camouflage to cover objects and like apparatuses. As a garment, the fabric containing one or more said substrate or system may be used for any suitable garment including, but not limited to, pants, shirts, outerwear such as jackets, shoes, hats, scarves, and belts. The camouflage and thermal management composite systems may undergo further operations to become a stealth liner, laminate system, or needle punched blended single textile applied to any other textile or solid surface; for example, a vehicle (e.g., a tank), a hangar or building structure or the like.

Aspects of the present disclosure are methods to create one or more high-performance thermal camouflage, thermal signature mitigation, and/or thermal insulation solutions for stealth applications. The following are examples of thermal solutions in which aspects of the present disclosure may be embodied or otherwise incorporated:

Building a Shell in the Battlefield

Figure 6:
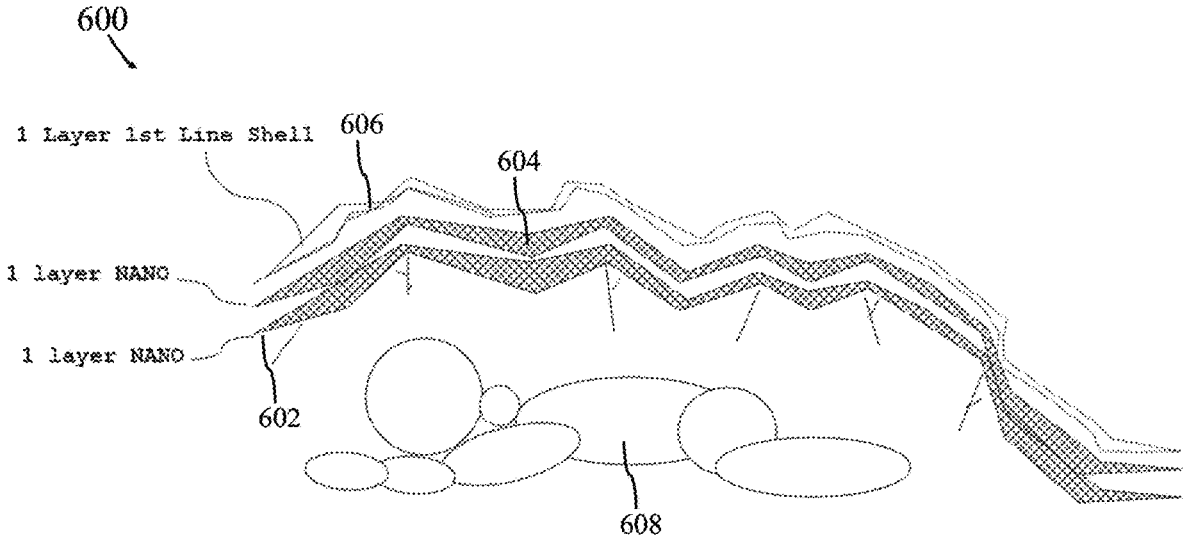
FIG. 6 is an illustration of a stealth shell, in accordance with certain aspects of the present disclosure.

Referring now to FIG. 6, an illustration 600 of a stealth shell is shown. In accordance with certain aspects of the present disclosure, a stealth shell is fabricated starting with one nano layer 602, equivalent to nano mesh substrate 302 of FIG. 3. In a second step, another nano layer 604, equivalent to nano mesh substrate 302 of FIG. 3, is layered on top of nano layer 602. In a third step, one layer of a first line shell 606, equivalent to system 102 of FIG. 1, is laid on top of nano layer 604. In a battlefield scenario, a war fighter 608 can easily deploy the ultra-thin and ultra-lightweight shell for concealment.

Stealth Tent

Figure 7:
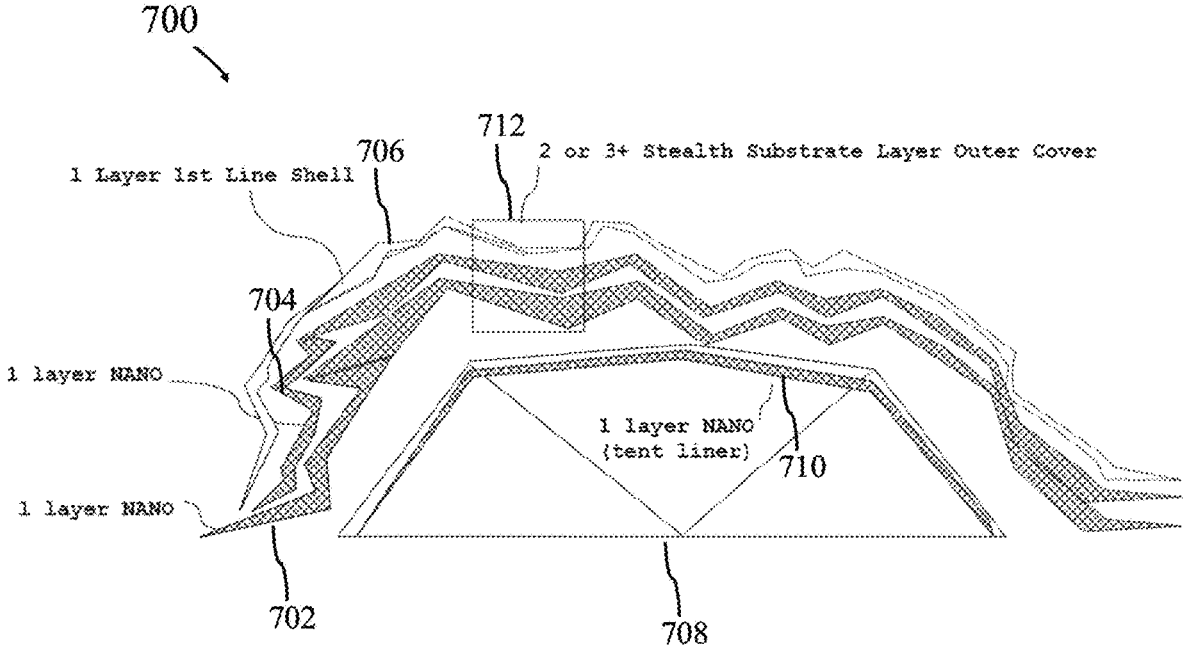
FIG. 7 is an illustration of a stealth tent, in accordance with certain aspects of the present disclosure.

Referring now to FIG. 7, an illustration 700 of a stealth tent is shown. In accordance with various aspects of the present disclosure, a stealth tent is fabricated starting with one nano layer 702, equivalent to nano mesh substrate 302 of FIG. 3. In a second step, another nano layer 704, equivalent to nano mesh substrate 302 of FIG. 3, is layered on top of nano layer 702. In a third step, one layer of a first line shell 706, equivalent to system 102 of FIG. 1, is laid on top of nano layer 704. In a final step, the inside of tent 708 is lined with one nano layer 710, equivalent to nano mesh substrate 302 of FIG. 3. In various alternative embodiments, two or more combinations of nano layer 702, 704, and 706 (shown as 712) may be applied on top of tent 708 depending on the environment.

An aspect of the present disclosure is a modular, scalable, ultra-thin, ultra-lightweight thermal camouflage, thermal signature mitigation, and thermal insulation system with adjustable performances achieved through combining the functions of one or more said dynamic layers to achieve specific levels of reflection, absorption, or emissivity in the near-infrared (NIR) and Infrared (IR) of the EM spectrum. An insulation system construct may be fabricated by layering said system 102 of FIG. 1 and nano mesh 302 of FIGS. 3 and/or 402 of FIG. 4 to exhibit low thermal mass properties with a balance of Spectral Radiance to match earth albedo with a "battlesight zero" responding in selective emissions within the NIR range and Gray Body Diffusion straight-line readings throughout the SWIR MIR and LIR wavelengths. Reflectance is aided by moderating transmission/absorption of these ultra-thin ultra-lightweight non-woven substrates to maximize a moderate Emissivity and create thermal mitigating/regulating structures in layers as each layer added becomes part of a mitigating strategy in the field. Reflectance and transmission can be increased with addition of boron Nitride (BN) in a G-RAM layer and increasing, for example, $TiO_2$ coatings in the reflective layer of a stealth coating. The BN is also added to assist in heat sink capabilities with the heat absorption (heat sink) function. In an embodiment, one or more preferred system construct may be fabricated to have a reflectance of more than 20% and less than 80% in the wavelength range of 700 nanometer to 2400 nanometer, preferably less than 50%, most preferably 25% reflectivity in the wavelength range of 1.100 μm to 24 μm to mimic the Earth's albedo. In another embodiment, one or more preferred system construct may be fabricated to possess a transmission of less than 50%, preferably between 25% to 50% transmission, most preferably between 30 to 40%, to maximize absorbance in the nano layer, in the wavelength range of 700 nanometer to 24 μm. In yet another embodiment, one or more preferred system construct may be fabricated to possess an emissivity of less than 50%, preferably between 25% to 50% emissivity, most preferably lower than 50% emissivity, with a mean of 40%, to maximize Gray Body Diffusion, in the wavelength range of 700 nanometer to 24 μm when measured according to the test method described herein.

Test Method

Figure 8:
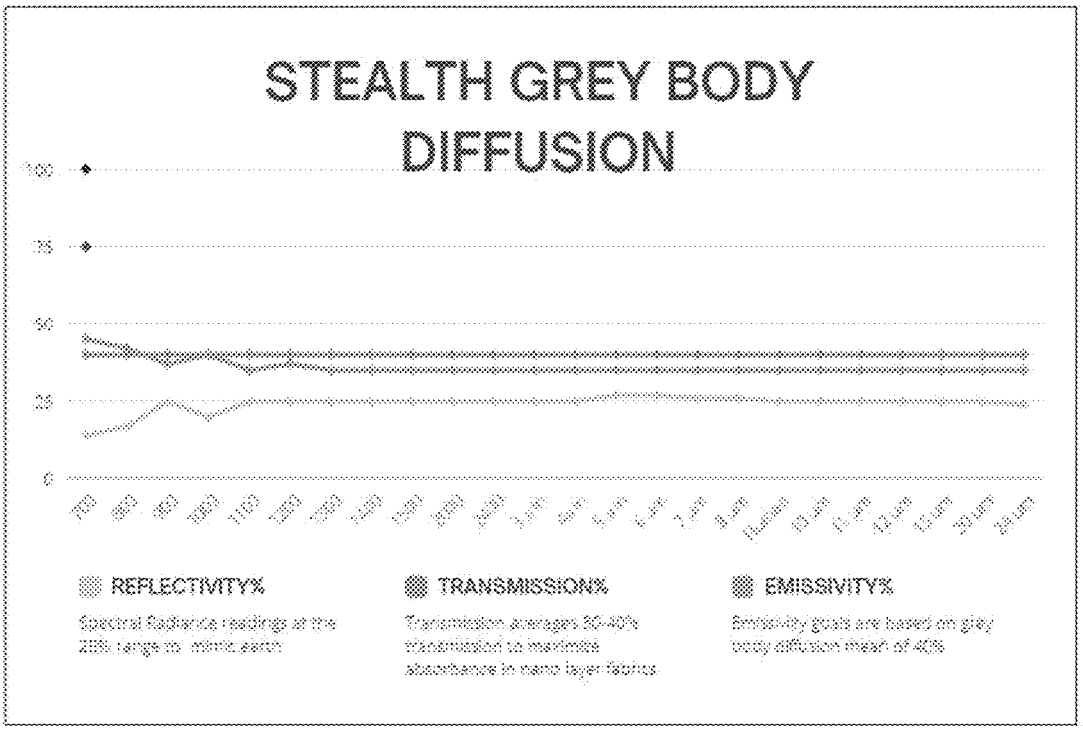
FIG. 8 is a graph containing the reflectivity, transmission, and emissivity percent data for Stealth Gray Body Diffusion constructs, in accordance with certain aspects of the present disclosure.

A Stealth Gray Body Diffusion construct comprising a combination of system 102 of FIG. 1, nano mesh 302 of FIG. 3 and 402 of FIG. 4 was fabricated for performance testing. Spectral reflectance ($\rho_\lambda$) was directly measured using a Thermo-Fisher Scientific Nicolet iS50 FTIR spectrophotometer with a Pike Technologies mid-IR IntegratIR™ integrating sphere. Spectral transmittance ($\tau_\lambda$) was assessed through comparison of reflection measurements made with and without a reflective backing behind a sample Stealth Gray Body Diffusion construct of the present disclosure. Measurements were made following the approach given by Method C of ASTM E408: Standard Test Methods for Total Normal Emittance of Surfaces Using Inspection-Meter Techniques. Referring now to FIG. 8, a graph is shown containing the reflectivity, transmission, and emissivity percent data for five Stealth Gray Body Diffusion constructs. The average reflectivity, transmission, and emissivity results are plotted demonstrating that these constructs can achieve 25% reflectivity, an average of 30 to 40% transmission, and an emissivity of 40% in the wavelength range of 700 nanometer to 24 μm. These results demonstrate that the constructs of the present disclosure display gray body diffusion characteristics and can be effective as a high-performance omni-spectral thermal camouflage, thermal signature mitigation, and/or thermal insulation system operating in the NIR, the "atmospheric windows" in the range of 1-3 μm, 3-5 μm or 8-12 μm, as well as longer wavelengths thus potentially satisfying future military camouflage requirements.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." As used herein, the terms "right," "left," "top," "bottom," "upper," "lower," "inner" and "outer" designate directions in the drawings to which reference is made.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one of a number or lists of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention.

What is claimed is:

1. A stealth material composition, comprising:

a non-woven shell layer comprising a spun bond fabric;

a thermal absorption layer disposed on the non-woven shell layer, the thermal absorption layer comprising a radar absorbing material comprising a conductive ink disposed on the non-woven shell layer, the conductive ink comprising a mixture of graphite particles and a binder; and a protective coating layer disposed on the thermal absorption layer, the protective coating layer comprising a polymer resin, wherein the conductive ink is disposed on the non-woven shell layer according to a printed pattern, wherein the printed pattern comprises a plurality of random or ordered apertures, wherein the plurality of random or ordered apertures are arranged to have a periodic separation distance in the range of 1.0 millimeters to 3.0 millimeters.

2. The stealth material composition of claim 1 wherein the spun bond fabric comprises one or more fibers being coated with a conductive material selected from the group consisting of graphite, graphite oxide and boron nitride.

3. The stealth material composition of claim 1 wherein the printed pattern comprises a Faraday cage pattern.

4. The stealth material composition of claim 1 wherein the printed pattern comprises a grid comprising one or more rows comprising the plurality of random or ordered apertures.

5. The stealth material composition of claim 4 wherein each aperture in the plurality of random or ordered apertures comprises a diameter in the range of 0.5 millimeters to 2.0 millimeters.

6. The stealth material composition of claim 1 wherein the spun bond fabric comprises one or more fiber type selected from the group consisting of polyester, polyimide and polypropylene.

7. The stealth material composition of claim 3 wherein the printed pattern comprises a random pattern.

8. The stealth material composition of claim 1 wherein the conductive ink comprises reflective aluminum particles or aluminum flakes.

9. The stealth material composition of claim 8 wherein the conductive ink comprises a near-infrared reflective pigment.

10. A stealth material composition, comprising:

a mesh layer comprising a semi-transparent mesh;

a thermal absorption layer disposed on the mesh layer, the thermal absorption layer comprising a radar absorbing material comprising a conductive ink disposed on the mesh layer, the conductive ink comprising a mixture of graphite particles and a binder; and a protective coating layer disposed on the thermal absorption layer, the protective coating layer comprising a polymer resin, wherein the conductive ink is disposed on the mesh layer according to a printed pattern, wherein the printed pattern comprises a plurality of random or ordered apertures, wherein the plurality of random or ordered apertures are arranged to have a periodic separation distance in the range of 1.0 millimeters to 3.0 millimeters.

11. The stealth material composition of claim 10 wherein the mesh layer is constructed of a 20-denier multifilament polyester material.

12. The stealth material composition of claim 10 wherein the mesh layer is constructed of a multifilament polyester material having a weight in the range of 0.8-1.05 ounces per square yard.

13. The stealth material composition of claim 10 wherein the mesh layer is constructed of a multifilament polyester material with a course count in the range of 42-48 threads per inch.

14. The stealth material composition of claim 13 wherein the mesh layer comprises a wale count in the range of 26-32 threads per inch.

15. A stealth material composition, comprising:

a substrate layer comprising a bicomponent fiber;

a thermal absorption layer disposed on the substrate layer, the thermal absorption layer comprising a radar absorbing material comprising a conductive ink disposed on the substrate layer, the conductive ink comprising a mixture of graphite particles and a binder; and a protective coating layer disposed on the thermal absorption layer, the protective coating layer comprising a polymer resin, wherein the conductive ink is disposed on the substrate layer according to a printed pattern, wherein the printed pattern comprises a plurality of random or ordered apertures, wherein the plurality of random or ordered apertures are arranged to have a periodic separation distance in the range of 1.0 millimeters to 3.0 millimeters.

16. The stealth material composition of claim 15 wherein the substrate layer comprises a bicomponent polyester.

17. The stealth material composition of claim 15 wherein the micro substrate layer comprises a weight in the range of 16.0 grams per square yard to 17.0 grams per square yard.

18. The stealth material composition of claim 15 wherein the substrate layer comprises a thickness in the range of 9.0 millimeters to 11.0 millimeters.

19. The stealth material composition of claim 15 wherein the substrate layer comprises a machine direction tensile strength in the range of 1000 grams per inch to 1200 grams per inch.

* * * * *